US008167828B2

(12) United States Patent
Tsai

(10) Patent No.: US 8,167,828 B2
(45) Date of Patent: May 1, 2012

(54) MASSAGE ASSEMBLY

(76) Inventor: Ming-Wei Tsai, Taipei Hsien (TW)

( * ) Notice: Subject to any disclaimer, the term of this patent is extended or adjusted under 35 U.S.C. 154(b) by 999 days.

(21) Appl. No.: 12/134,967

(22) Filed: Jun. 6, 2008

(65) Prior Publication Data

US 2009/0306559 A1 Dec. 10, 2009

(51) Int. Cl.
*A61H 7/00* (2006.01)

(52) U.S. Cl. ..... 601/98; 601/99

(58) Field of Classification Search ..... 601/49, 601/56–60, 84–87, 90–91, 93–94, 97–99, 601/112, 113, 115, 116, 121, 126, 127, 133, 601/134, 136
See application file for complete search history.

(56) References Cited

U.S. PATENT DOCUMENTS

| | | | | |
|---|---|---|---|---|
| 6,196,983 | B1 * | 3/2001 | Wu | 601/99 |
| 6,840,914 | B1 * | 1/2005 | Takamura | 601/99 |
| 7,419,475 | B2 * | 9/2008 | Ferber et al. | 601/99 |
| 7,470,242 | B2 * | 12/2008 | Ferber et al. | 601/100 |
| 7,597,669 | B2 * | 10/2009 | Huang | 601/86 |

* cited by examiner

*Primary Examiner* — Michael A. Brown
(74) *Attorney, Agent, or Firm* — Birch, Stewart, Kolasch & Birch, LLP

(57) ABSTRACT

A massage assembly includes a top cover and a base which is connected to the top cover to define a space therebetween, a massage unit and a movable unit is received in the space. The massage unit is connected to the movable unit, and a transmission mechanism is received in the movable unit to drive the movable unit to move reciprocally in the massage assembly so as to massage the user's body by the massage unit. The massage unit provides different types of massage features.

12 Claims, 9 Drawing Sheets

MASSAGE ASSEMBLY

BACKGROUND OF THE INVENTION

1. Field of the Invention

The present invention relates generally to a massage assembly using worm shafts to drive worm gears so as to obtain multiple types of massage features.

2. The Prior Arts

A conventional massage assembly generally includes two massage parts which are movable along two circular tracks. Two worm shafts are used to drive two worm gears which are moved relative to each other and each worm gear has a massage member connected eccentrically thereon so as to massage the user's body. The conventional massage assembly can only provide one single and fixed massage feature.

SUMMARY OF THE INVENTION

A primary objective of the present invention is to provide a massage assembly which is designed to improve the shortcomings of the conventional massage assemblies and uses a mechanism which includes worm shafts to drive worm gears so as to provide different types of massage features.

Another objective of the present invention is to provide a mechanism which drives massage devices to move reciprocally and along a pre-set rail so as to save cost of controlling circuits and increase the reliability of the massage assembly.

The massage assembly of the present invention includes a base and a top cover connected to the top cover to define a space therebetween. A massage unit is connected to a movable unit which is received in the space. The movable unit is driven by a first transmission unit to move reciprocally in the base, and the massage unit is driven by a second transmission unit to rotate and move in vertical direction so as to massage the user's body with different types of massage features.

In order to achieve the purpose of repeatedly massage to the user's body, a loop rail is provided in the base and two straight rails are located on two long sides of the loop rail. A driving gear is cooperated with the movable unit and engaged with the loop rail. The driving gear moves along the loop rail so as to move the movable unit, and the straight rails provides a proper limitation to the movement of the movable unit. The movable unit turns when the driving gear moves along the curved portions of the loop rail so that the movable unit moves along the loop-shaped trace.

In order to achieve the purpose of kneading, a massage disc with massage balls is provided, the massage disc is cooperated with an universal joint receiving seat which is connected with the second transmission unit so that the massage disc rotates in the horizontal direction when the universal joint receiving seat rotates to provide kneading feature to the user.

In order to achieve the purpose of massaging, a tilt frame is provided, which includes internal teeth and has a higher portion. The tilt frame is connected to an underside of the massage disc and planet gears are engaged with the internal teeth of the tilt frame. When the second transmission unit is operated, the planet gears moves in opposite direction with regard to the direction of the movement of the tilt frame such that the higher portion performs as a cam-like action to massage the user's body.

The massage unit farther includes heating devices such as ceramic heating tubes, heat wires, heat resistances, or lamps. In this embodiment of the present invention, miniature lamps are used which light up during use and provide heat to the user's body.

The massage unit of the present invention provides the following advantages:

1. The present invention includes two motors, one of which drives the movable unit and the other motor drives the massage unit.
2. By using the universal joint and the tilt frame, the massage disc and the massage balls can move not only in the horizontal direction, but also in the vertical direction so as to provide different kneading massage features.
3. The movable unit moves along the loop rail is controlled by mechanical way which saves the cost of controlling circuits.
4. The present invention does not have any detection or sensing devices so as to avoid shortcomings due to malfunction of these detection or sensing members.
5. The travel length of the movable unit can be adjusted according needs.
6. The actions of the massage members are continuous and the structure is compact and reliable.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
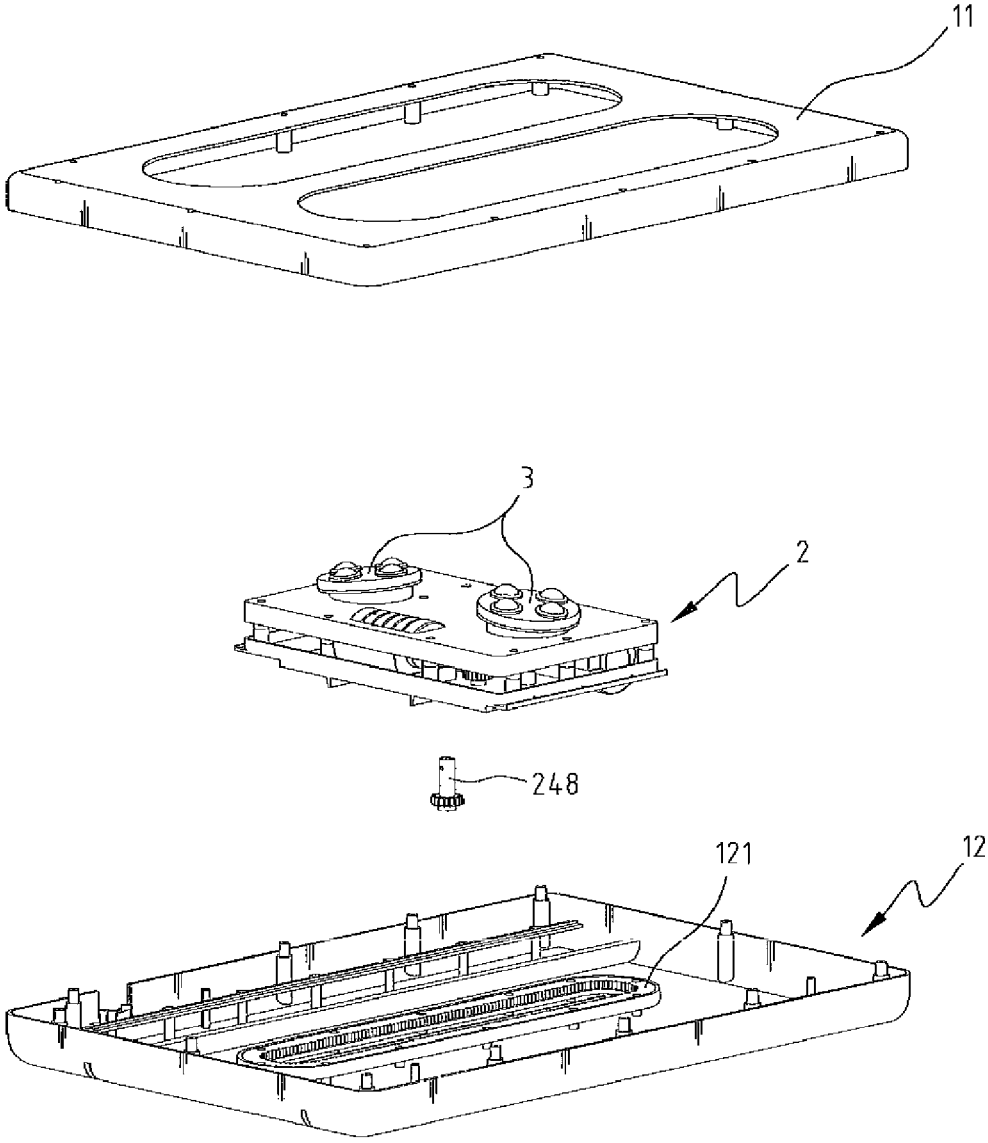
FIG. 1 is an exploded view of a massage assembly in accordance with the present invention.

With reference to the drawings and in particular to FIG. 1, a massage assembly in accordance with the present invention comprises a top cover 11, a base 12 which is connected to the top cover 11 so as to define a space therebetween, a movable unit 2 and a massage unit 3.

Figure 2:
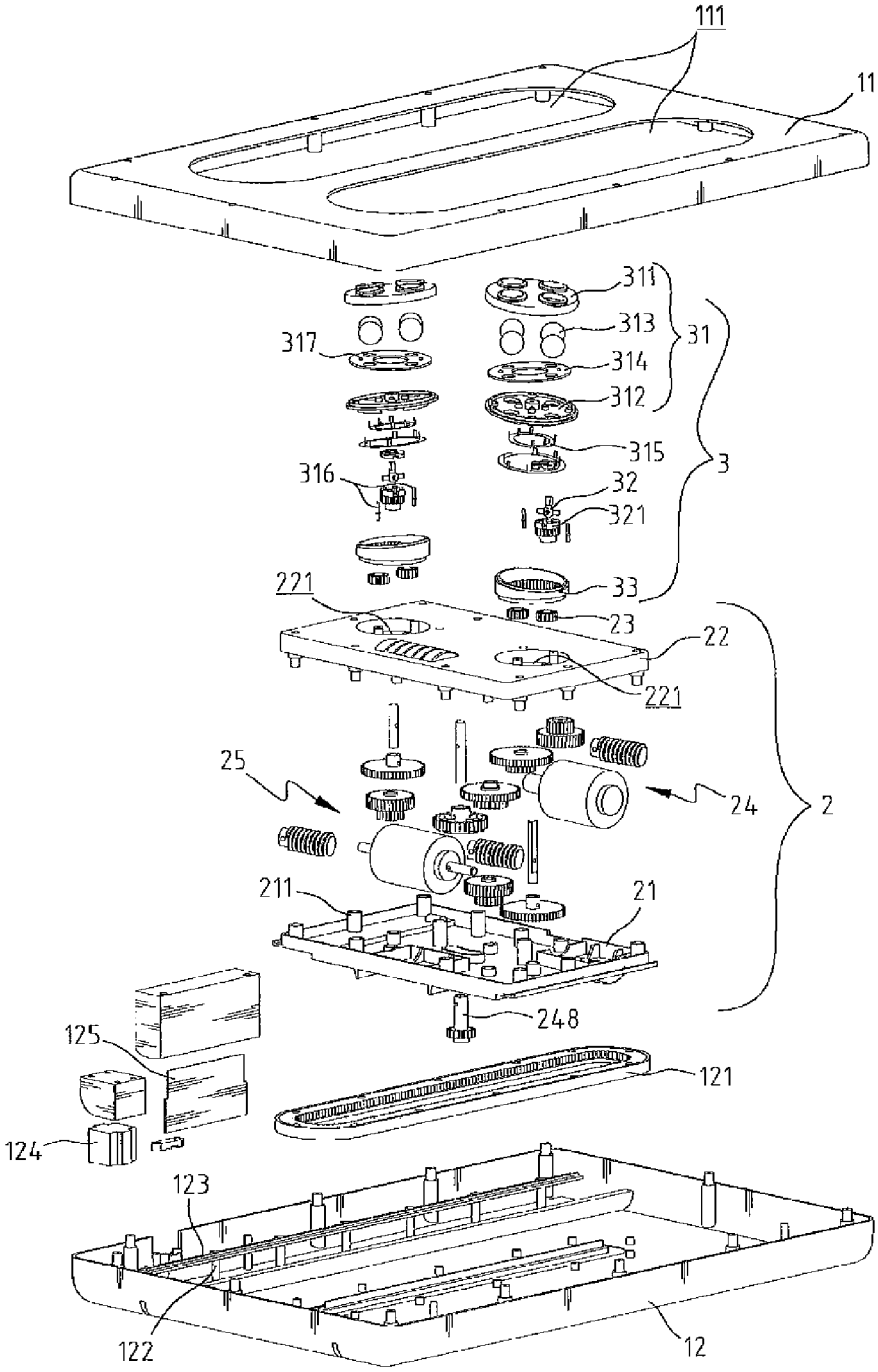
FIG. 2 is an exploded view of a movable unit and a massage unit of the massage assembly in accordance with the present invention.
Figure 2A:
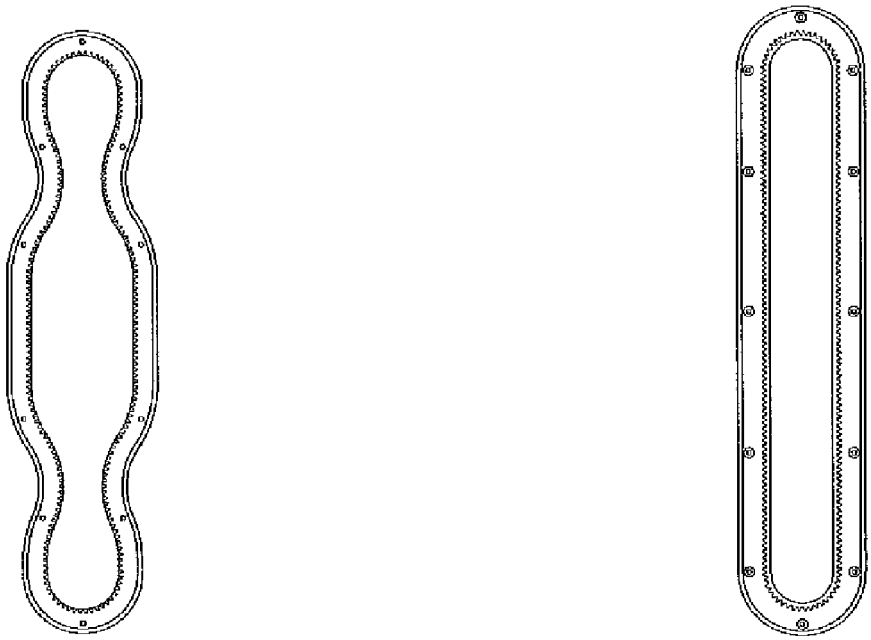
FIG. 2A shows two different shapes of loop rails used for the massage assembly in accordance with the present invention.

As shown in FIG. 2, the base 12 has a loop rail 121 located at a center thereof and the loop rail 121 is a closed and elongate loop which has two straight sides with two curved portions and teeth defined in its inside as shown in FIG. 2A. The shape of the loop rail 121 can also be non-uniform such as the left loop rail shown in FIG. 2A. Two rows of rods 122 are located on two sides of the loop rail 121 and two straight rails 123 are connected along the rods 122. The two straight rails 123 are parallel to each other. The base 12 may accommodate adapter, circuit board 125 and wires which are electrically connected to the movable unit 2 and the massage unit 3. The top cover 11 has two openings 111 through which the massage unit 3 extends.

The movable unit 2 is composed of an upper board 21 and a bottom board 22 which is connected to the upper board 21 so as to define a space in which a transmission mechanism for driving the movable unit 2 and the massage unit 3 is received. The bottom board 21 has multiple connection tubes 211 so as to be connected with the transmission unit and the upper board 22 has through holes 221 for the massage unit 3.

Two the massage units 3 are provided in the present embodiment, and the number of the massage unit can be set according to needs. The massage actions in this embodiment includes that the movable unit 2 moves along the loop rail 121 reciprocally, the massage unit 3 rotates in horizontal direction and the massage unit 3 moves in the vertical direction. The mechanism for driving the massage unit 3 to be operated in the horizontal direction includes a massage disc 31 which has an upper plate 311 and a bottom plate 312. The upper plate 311 and the bottom plate 312 each have multiple circular holes and massage balls 313 are engaged between the circular holes. A universal joint 32 extends through the bottom plate 312 and a sphere of the universal shaft 32 is engaged with a universal joint receiving seat 321 which has external teeth defined in outside thereof. The mechanism for driving the massage unit 3 to be operated in vertical direction includes a tilt frame 33 located beneath the bottom plate 312 corresponding thereto. The tilt frames 33 each have internal teeth defined in an inside thereof and are received in the through holes 221 in the top cover 22. Two planet gears 23 are engaged with the internal teeth in each of the tilt frames 33 and the external teeth of the universal joint receiving seat 321.

Figure 2B:
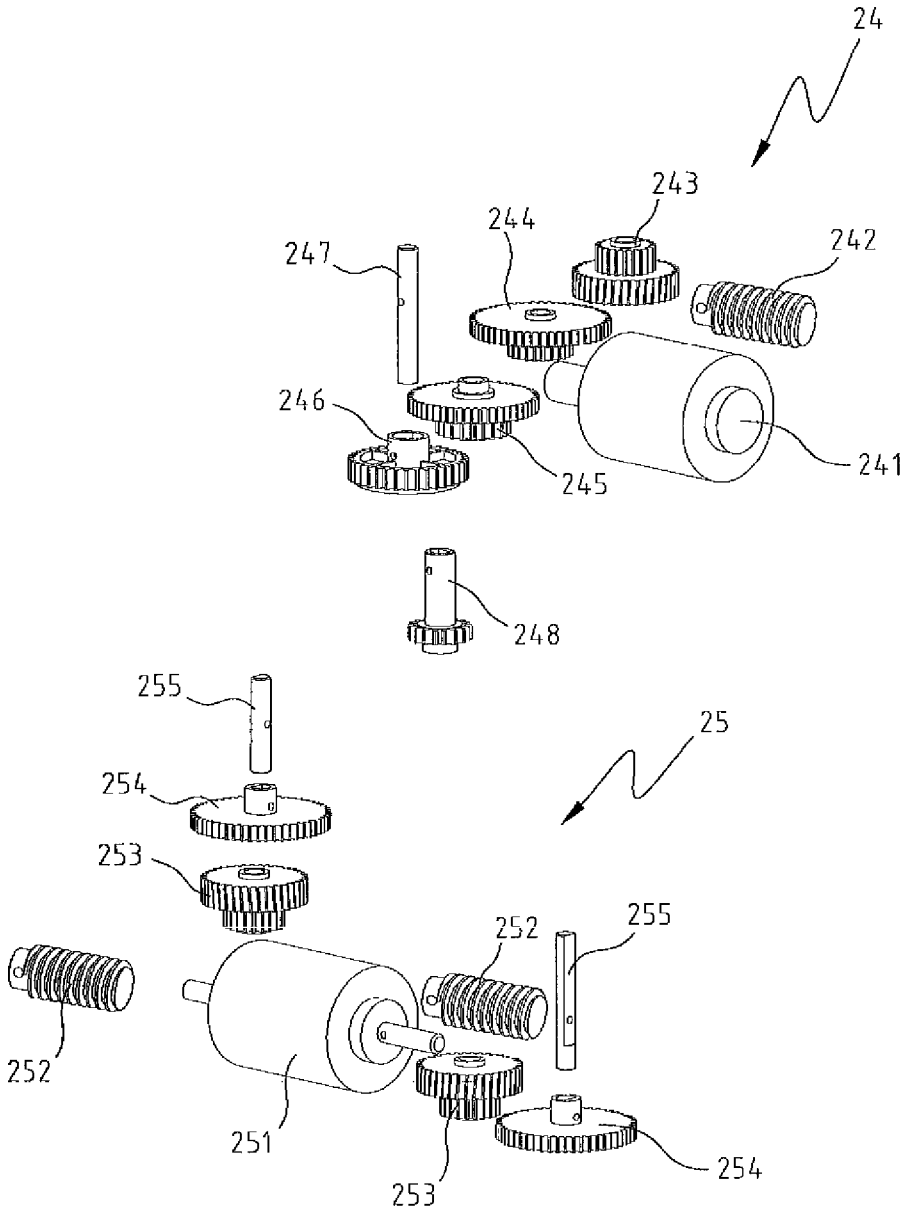
FIG. 2B shows two transmission units for the massage assembly in accordance with the present invention.

As shown in FIG. 2B, the transmission mechanism includes a first transmission unit 24 for driving the movable unit 2 and a second transmission unit 25 for driving the massage unit 3. The first transmission unit 24 includes a first motor 241 which has one output shaft connected with a first worm shaft 242. The first worm shaft 242 is engaged with a first dual-gear 243 which is engaged with a second dual-gear 244 which is engaged with a third dual-gear 245 which is engaged with a first single gear 246. A first shaft 247 extends through a center of the first single gear 246. A driving gear 246 has a shaft which extends through the base 21 from its underside thereof and is connected with the first shaft 247. The driving gear 248 is engaged with the teeth of the loop rail 121. These gears mentioned above are mounted to the connection tubes 211. A micro control unit (not shown) is connected with the first transmission unit 24 so as to control limit switches (not shown) in the movable unit 2. The second transmission unit 25 includes a second motor 251 which has two output shafts and two respective second worm shafts 252 are connected to the two output shafts. Each second worm shaft 252 is engaged with a fourth dual-gear 253 which is engaged with a second single gear 254 which has a second shaft 255 extending through a center thereof which extends through the top cover 22 of the movable unit 2 and is inserted into the tilt frame 33 and connected to the universal joint receiving seat 321.

The massage unit 3 further includes a circuit board 314 connected to the bottom plate 312 of the massage disc 31 and miniature lamps 317 are connected to the circuit board 314. The miniature lamps 317 can light up and generate heat. A copper ring 315 is connected to the underside of the bottom plate 312 and two stimulation probes 316 are connected to the upper board 22 of the movable unit 2.

Figure 3:
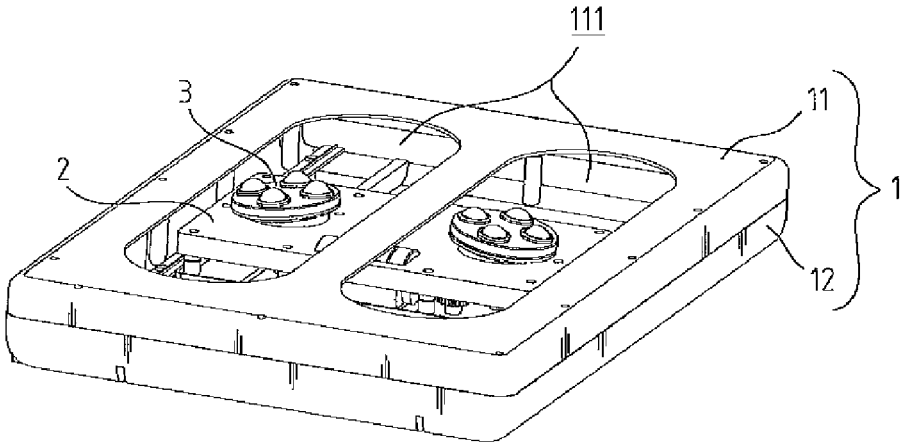
FIG. 3 is a perspective view to show the massage assembly in accordance with the present invention.
Figure 4:
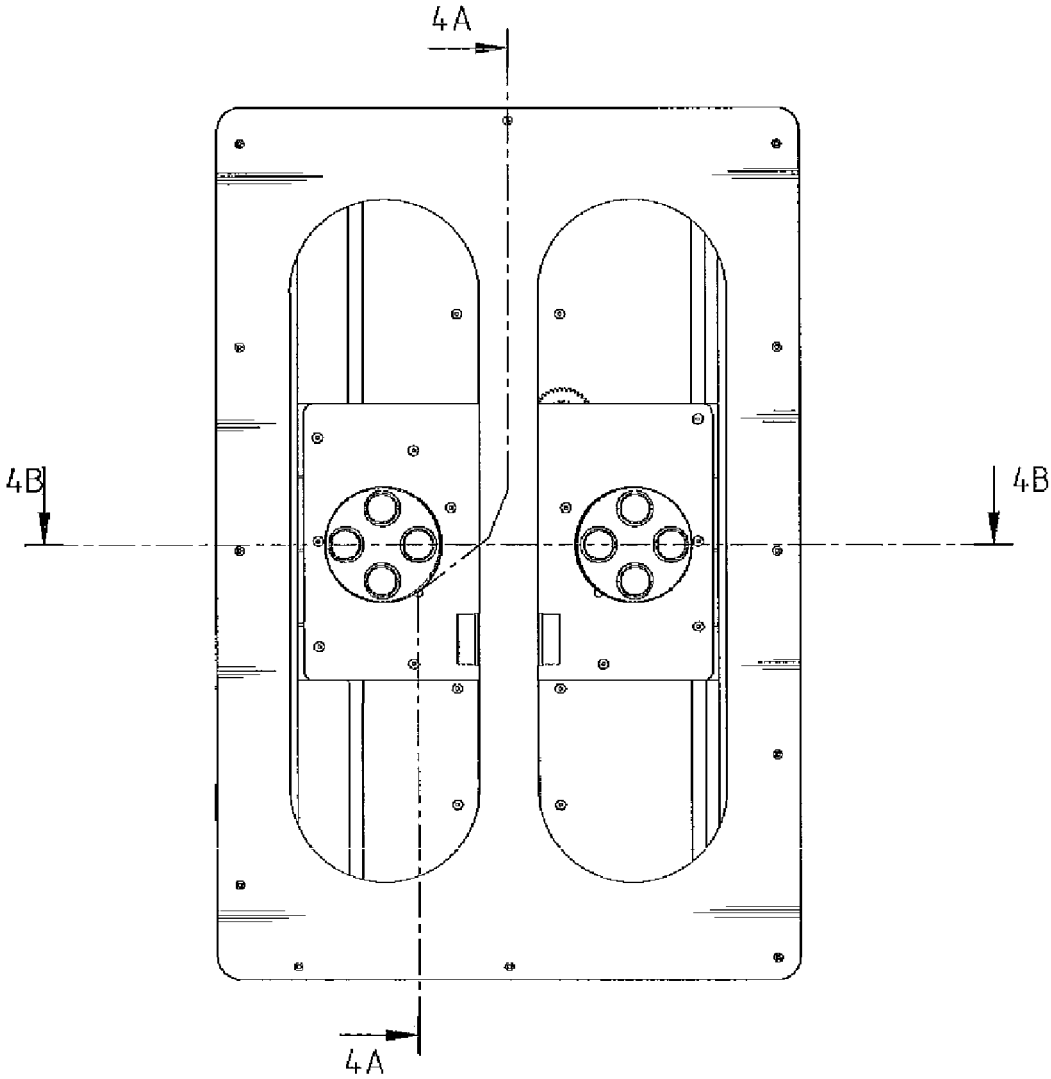
FIG. 4 is a top view to show the massage assembly in accordance with the present invention.
Figure 4A:
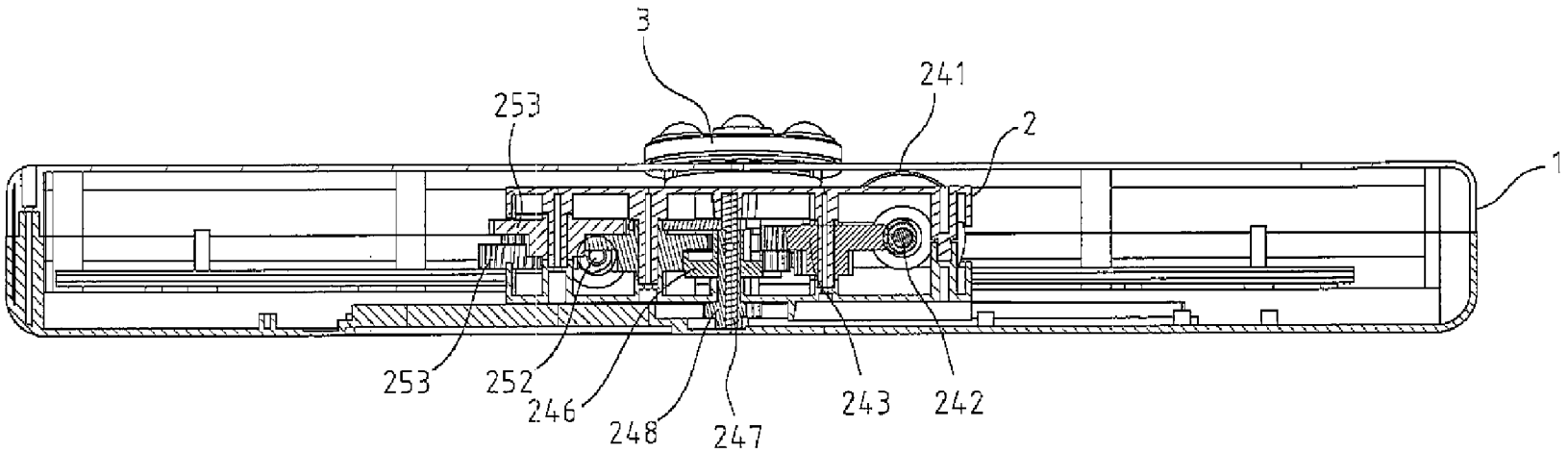
FIG. 4A is a cross sectional view taken along line 4A-4A in FIG. 4.
Figure 4B:
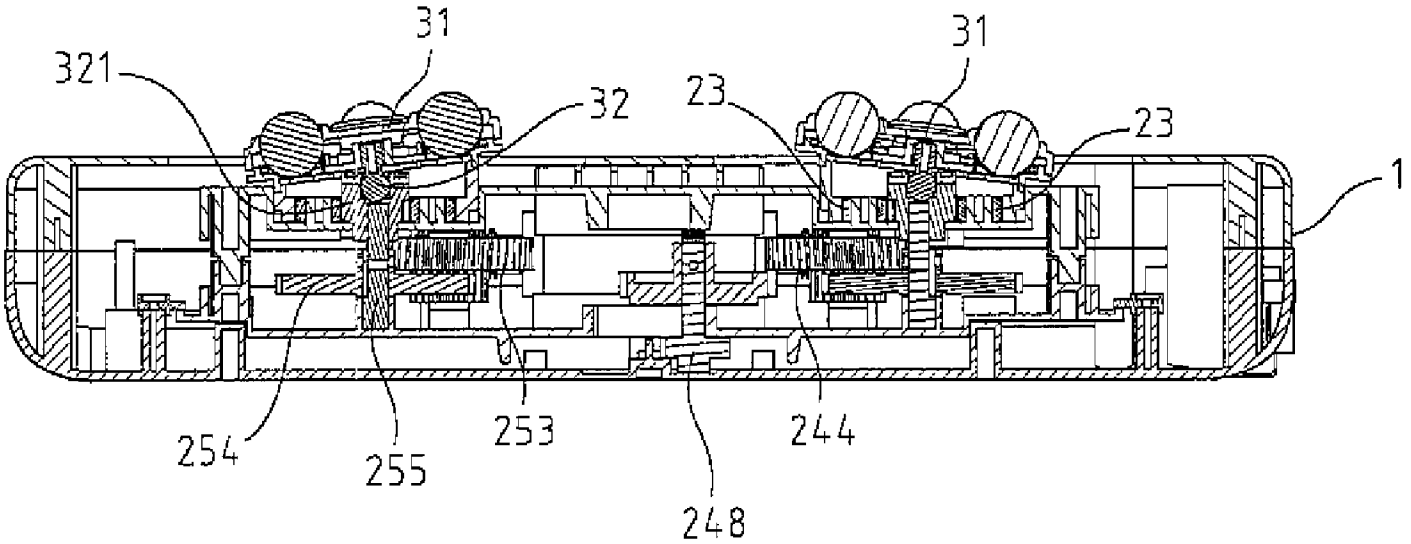
FIG. 4B is a cross sectional view taken along line 4B-4B in FIG. 4.

As shown in FIG. 1, the movable unit 2 is indirectly connected to the loop rail 121 by engaging the driving gears 248 with the teeth of the loop rail 121. FIG. 3 shows the massage assembly wherein the movable unit 2 and the massage unit 3 can be seen via the openings 111 in the top cover 11.

As shown in FIGS. 2, 2A, 2*b*, 4, 4A and 4B, when the first motor 241 is activated, the first worm shaft 242 is rotated to drive the first, second and third dual-gears 243, 244, 245 and the first single gear 246. The first shaft 247 drives the driving gear 248 which is engaged with the teeth of the loop rail 121 so as to move the movable unit 2 along the loop rail 121. The movable unit 2 turns to opposite direction when the driving gears 248 moves along the curved portions of the loop rail 121. Besides, the two parallel straight rails 123 can be used to limit the freedom of movement of the movable unit 2. In the meantime of the movement of the movable unit 2, the second motor 251 is activated and the two second worm shafts 252 are rotated and each second worm shaft 252 drives the fourth dual-gear 253 which drives the second single gear 254. The second shaft 255 drives the universal joint receiving seat 321 to rotate the universal joint 32. Because the universal joint 32 is engaged with the universal joint receiving seat 321 by the sphere so that the universal joint 32 rotates. The massage disc 31 is connected to the universal joint 32 so that it is co-rotated with the universal joint 32 so that the massage balls 313 springs relative to the upper plate 311 and the bottom plate 312. The massage disc 31 rotates in horizontal direction by the second shaft 255. In the same time, the universal joint receiving seat 321 drives the two planet gears 23 which move the tilt frame 33 in opposite direction with regards to the direction of the massage disc 31. Because the tilt frames 33 each have a higher portion so that when the tilt frames 33 rotate, the massage discs 31 also move in vertical direction. The copper ring 315 and the stimulation probes 316 are powered by the power source and the miniature lamps 317 on the circuit board 314 are powered via the copper ring 315, the miniature lamps 317 light up and the whole massage disc 31 generates heat.

The present invention uses the loop rail 121 to let the movable unit 20 move reciprocally and this movement is done by mechanical way. Only the motors are powered by electric power and this makes the massage assembly to be reliable. The shapes of the loop rails 121 can be different as shown in FIG. 2A. The massage discs 31 rotate in both horizontal and vertical directions so that the massage balls 313 provide kneading feature when the user's body leans against the massage assembly 1 of the present invention.

Figure 5:
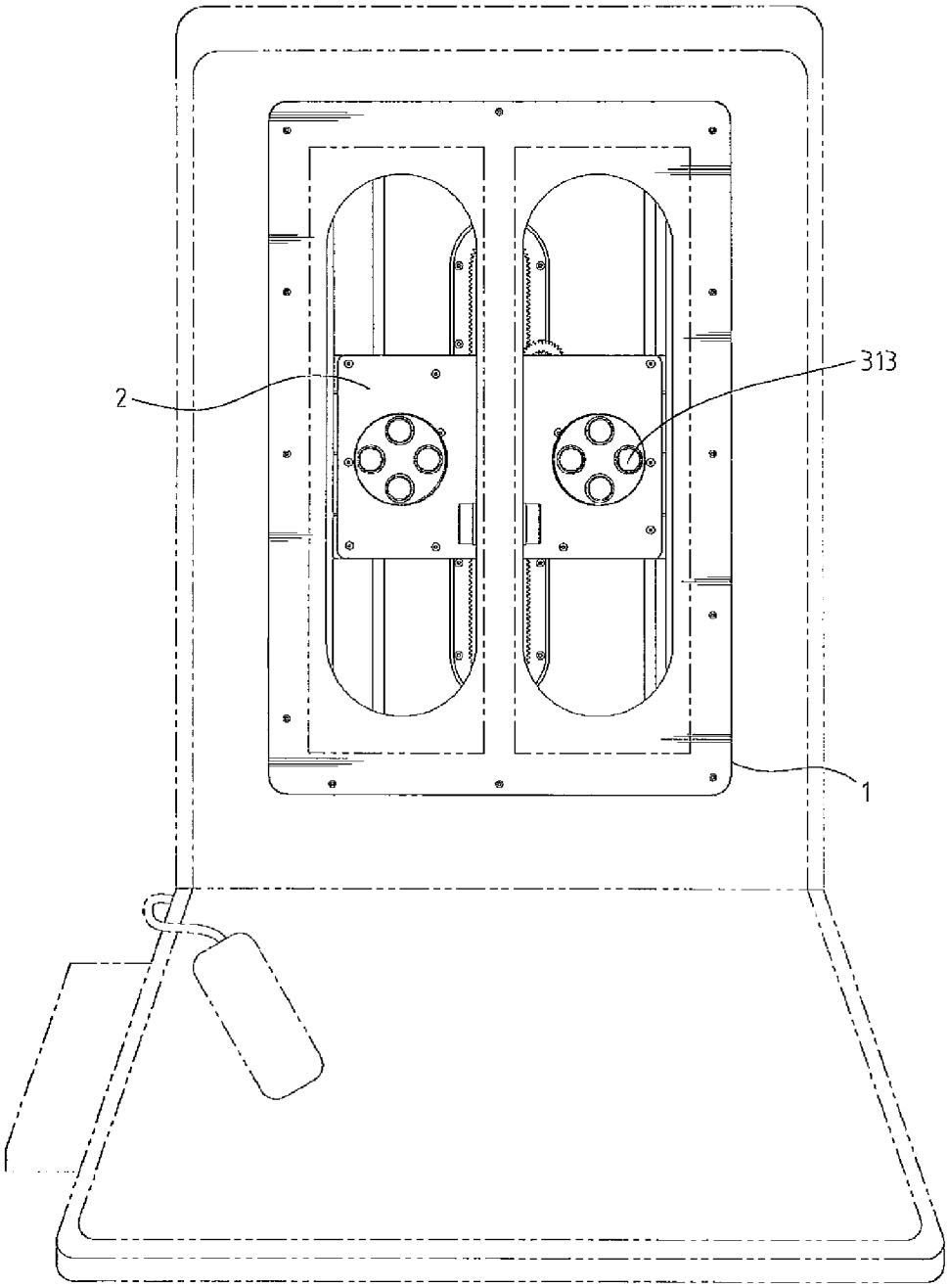
FIG. 5 shows that the massage assembly of the present invention is installed in a backrest of a chair.

The massage assembly 1 of the present invention can be used to massage limbs of the users such as arms, feet, or neck. FIG. 5 shows that the massage assembly 1 is installed in a backrest of a chair and the user can feel the massage when leaning on the backrest. The backrest can be made to be thin and transparent so that the user can clearly feel and see the massage balls 313 and the heat from the massage assembly 1.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A massage assembly, comprising a top cover and a base connected to the top cover to define a space therebetween, a massage unit and a movable unit received in the space;

the movable unit including an upper board and a bottom board connected to the upper board to define a space therebetween and a transmission mechanism received in the space of the movable unit;

the base including a loop rail connected thereto and a driving gear located between the loop rail and the movable unit, the driving gear engaged with teeth defined in the loop rail and being driven by the transmission mechanism to move reciprocally along the loop rail, and the top cover including openings through which the massage unit extends, the massage unit including a tilt frame, an universal joint receiving seat and a massage disc on which massage balls are engaged, the transmission mechanism driving the massage unit in horizontal and vertical directions, the massage unit having a heating unit.

2. The massage assembly as claimed in claim 1, wherein two parallel straight rails are connected to the base and located on two sides of the loop rail so as to limit the directions that the movable unit moves.

3. The massage assembly as claimed in claim 1, wherein the loop rail includes straight sides.

4. The massage assembly as claimed in claim 1, wherein the loop rail is a non-uniform rail.

5. The massage assembly as claimed in claim 1, wherein the transmission mechanism includes a first transmission unit for driving the movable unit and a second transmission unit for driving the massage unit.

6. The massage assembly as claimed in claim 5, wherein the first transmission unit includes a first motor which has one output shaft connected with a first worm shaft, the first worm shaft is engaged with a gear train which dives the driving gear.

7. The massage assembly as claimed in claim 5, wherein the massage assembly includes two massage units, and the second transmission unit includes a second motor which has two output shafts and two respective second worm shafts are connected to the two output shafts, the second worm shafts are engaged with two respective gear trains and each gear train drives one of the two massage units.

8. The massage assembly as claimed in claim 6, wherein the first transmission unit is connected with a micro control unit and multiple limit switches.

9. The massage assembly as claimed in claim 7, wherein the massage disc further includes an upper plate and a bottom plate, the massage balls are located between the upper plate and the bottom plate, an universal joint and the universal joint receiving seat are connected to an underside of the bottom plate, the universal joint receiving seat is connected to a second shaft of the second transmission unit, the second shaft drives the massage disc to rotate in horizontal direction.

10. The massage assembly as claimed in claim 1, wherein the massage balls rotate in the massage disc.

11. The massage assembly as claimed in claim 1, wherein the tilt frame has internal teeth defined in an inside thereof and the universal joint receiving seat has external teeth defined in an outside thereof, two planet gears are engaged with the internal teeth in the tilt frame and the external teeth of the universal joint receiving seat, the two planet gears are driven by the universal joint receiving seat so the tilt frame rotates in opposite direction with regard to the massage disc so that the tilt frame moves in vertical direction.

12. The massage assembly as claimed in claim 9, wherein the heating unit includes two stimulation probes connected to the upper board of the movable unit and a copper ring connected to an underside of the upper plate of the massage disc, a circuit board is connected to the bottom plate of the massage disc and miniature lamps are connected to the circuit board on the bottom plate.

* * * * *